US006666668B1

(12) United States Patent
Kaechele

(10) Patent No.: US 6,666,668 B1
(45) Date of Patent: Dec. 23, 2003

(54) STATOR WITH RIGID RETAINING RING

(75) Inventor: Bruno Kaechele, Weilheim an der Teck (DE)

(73) Assignee: Wilhelm Kaechele GmbH Elastomertechnik, Weilheim an der Teck (DE)

( * ) Notice: Subject to any disclaimer, the term of this patent is extended or adjusted under 35 U.S.C. 154(b) by 0 days.

(21) Appl. No.: 10/110,973

(22) PCT Filed: Oct. 5, 2000

(86) PCT No.: PCT/DE00/03491

§ 371 (c)(1),
(2), (4) Date: Apr. 18, 2002

(87) PCT Pub. No.: WO01/29422

PCT Pub. Date: Apr. 26, 2001

(30) Foreign Application Priority Data

Oct. 18, 1999 (DE) ..... 199 50 258

(51) Int. Cl.[7] ..... F01C 1/10
(52) U.S. Cl. ..... 418/48; 418/153
(58) Field of Search ..... 418/48, 153

(56) References Cited

U.S. PATENT DOCUMENTS 2,428,995 A * 10/1947 Rogers ..... 418/48
4,863,359 A * 9/1989 Unterstrasser et al. ..... 418/48
5,318,416 A * 6/1994 Hantschk et al. ..... 418/48
5,779,460 A * 7/1998 Marz ..... 418/48
6,162,032 A * 12/2000 Jager ..... 418/48

FOREIGN PATENT DOCUMENTS

DE 2937403 A * 4/1981 ..... F04C/2/10
EP 935071 A1 * 8/1999 ..... F04C/2/107
EP 935072 A1 * 8/1999 ..... F04C/2/107

* cited by examiner

*Primary Examiner*—Thomas Denion
*Assistant Examiner*—Theresa Trieu
(74) *Attorney, Agent, or Firm*—Foley & Lardner

(57) ABSTRACT

On an eccentric screw pump or an eccentric screw motor, both the outer wall and the inner wall of the jacket (21) have a helicoid form. In order to stabilise the cross-sectional profile of the jacket (21) in the vicinity of the ends and to allow it to be simply coupled to the other housing sections (5, 6), a retaining ring (28) sits on each end of the jacket (21). The retaining ring contains a through channel (32), whose cross-sectional surface has a form which substantially corresponds to the cross-sectional surface that is delimited by the inner wall (23) or outer wall (24).

24 Claims, 4 Drawing Sheets

STATOR WITH RIGID RETAINING RING

BACKGROUND OF THE INVENTION

The essential constituent parts of an eccentric screw pump are the stator, the rotor, which runs therein, and the drive for the rotor. The rotor has the configuration of a screw with one or more turns and rotates in the bore of the stator, which likewise has a helical configuration, the number of turns of the bore of the stator being higher than the number of turns of the screw of the rotor.

In order to achieve the necessary sealing between the stator and rotor, the stator is provided with an elastomeric lining against which the rotor butts in a sealed manner. Sickle-shaped or banana-shaped chambers are produced between the rotor and the stator, and these chambers move from the suction side to the pressure side during operation of the rotor. The medium is delivered in these chambers.

Eccentric screw pumps are suitable for transporting viscous media under high pressure and for delivering media with solid particles. Furthermore, this design principle may also be used as a motor if the medium is pressed into the arrangement under high pressure, as a result of which the rotor is made to revolve in the stator. Applications of this are constituted by so-called underground drilling motors.

Functioning, results in both the stator and the rotor being wearing parts, which need to be exchanged regularly. This requires dismantling that, naturally, should take place as straightforwardly as possible, in particular when large pumps or motors are involved.

As far as the stator is concerned, two different types of design are known. In the case of one type of design, the lining is located in a smoothly cylindrical tube, the helical contour being restricted exclusively to the elastomeric lining. The elastomeric lining is thus more compliant in the region of the thread crests than in the region of the thread troughs. Pumps of this type make it possible to produce a relatively low pressure for each stage because the relatively pronounced compliance in the region of the thread crest limits the maximum pressure.

In the case of the other type of construction, the casing is likewise, once again, a tube that nevertheless, for its part, is deformed helically. The lining has a constant wall thickness at all points both in the longitudinal direction and in the circumferential direction. This makes it possible to achieve very high pressures in comparative terms.

While in the case of the embodiment with a cylindrical casing the connection to the other pump-housing parts is comparatively straightforward, it is problematic in the case of the helically deformed tube. In the case of the simplest embodiment with a two-turn screw, the cross-section of the tube has the configuration of an oval similar to a racetrack, the available end surface of the casing being comparatively narrow. It is correspondingly difficult to achieve the sealing and the fastening on the pump housing.

Furthermore, the helically configured casing is sensitive to deformation at the ends on account of the pressure built up in the interior. While, in the central region of the stator, the adjacent stator regions help to stabilize the shape of said central region, free edges occur at the ends, which can easily result in deformation on the pressure side and thus in a loss of pressure, which limits the maximum possible pressure of the pump.

Taking this as the departure point, the object of the invention is to provide an eccentric screw pump or motor of which the stator has a helically configured casing and which can be easily connected to the rest of the housing parts, the ends thereof, without any significant increase in the axial length, being protected in an effective manner against changes in configuration as a result of the static pressure of the medium.

SUMMARY OF THE INVENTION

This object is achieved according to the invention by an eccentric screw pump or an eccentric screw motor having the features of claim 1.

The end ring, of which the through-opening continues the helical configuration of the interior of the stator casing, helps to achieve two things:

The complicated geometry of the stator end is transferred into a geometry which can easily be connected to the parts of the pump housing. This simultaneously provides a sufficiently large surface for accommodating seals. The surfaces are large enough in order for crushing of the seal to be prevented in an effective manner.

Furthermore, without the construction of the stator being extended in any way, the end ring allows the stator end to be secured against expansion, in particular the rectilinearly running section of the casing cross section decreasing [sic] sensitive to deformation. These regions are stabilized by the end ring and thus obtain a similar strength to that in the central region of the stator.

It is possible, for example, for the end ring to be designed as a flange plate which can be screwed to a correspondingly [sic] flange on the pump head or on the connection head, the two lying flat one upon the other.

That embodiment of the end ring which differs from the above in principle has a narrow ring, with a circular outer contour, which can be plugged into a corresponding stepped bore, designed as a seat, on the pump head or on the connection head. Here too, correspondingly large sealing surfaces are produced. The casing of the stator we [sic] particularly reinforced in the sections of the cross-sectional profile which have a low level of curvature, because, in these regions, the end ring, in order to follow the cylindrical outer configuration, has a particularly large wall thickness and is flexurally rigid.

Two embodiments are possible, in principle, for connecting the end ring straightforwardly to the casing of the stator. In one case, the end ring has a through-passage opening which has a constant cross section, as seen over the length, the cross section essentially coinciding with the outer cross section of the casing in order that the end ring can be screwed onto the casing like a type of nut. In order to prevent the end ring from being screwed onto the casing to too great an extent, a shoulder is formed on the casing. The shoulder may be formed by material being applied at the location of the shoulder or by material being removed from the outer circumferential surface, starting from the end of the casing. The simplest way of removing the material is by stripping the outer surface of the casing over the length over which the end ring is to be screwed on. As a result, the outer contour is only changed at those points at which the casing has the greatest radial extent. It goes without saying that the inner contour of the opening in the end ring is adapted to this changed outer contour of the casing, in order that only a very small installation gap is produced between the through-passage opening and the outer circumferential surface of the casing. This embodiment, furthermore, has the advantage that the end ring obtains a usable wall thickness at its weakest point.

The other of the two abovementioned variants makes use of an end ring in the case of which the through-passage opening is configured as a stepped bore, with the result that a shoulder is produced in the end ring, said shoulder positioning itself against the end surface of the casing as the end ring is screwed on. In this case, the cross section of the one section corresponds to the stepped bore of the outer cross section of the casing, while that section of the stepped bore which has a small [sic] surface area constitutes a fairly precise continuation of the interior of the casing.

In all cases, it is ensured that the end surfaces of the end ring are positioned at right angles in relation to the axis of the casing.

The end ring, once placed in position, may be connected integrally to the casing in order to improve the stability further. This expediently takes place by the end surface of the casing being welded to the end ring. Welding exclusively on the outer side would likewise be conceivable, but would leave a gap on the inner side, which gap possibly takes effect in the event of loading and could damage the continuous lining.

BRIEF DESCRIPTION OF THE DRAWINGS

An exemplary embodiment of the subject matter of the invention is illustrated in the drawing, in which.

DETAILED DESCRIPTION OF THE PREFERRED EMBODIMENTS

Figure 1:
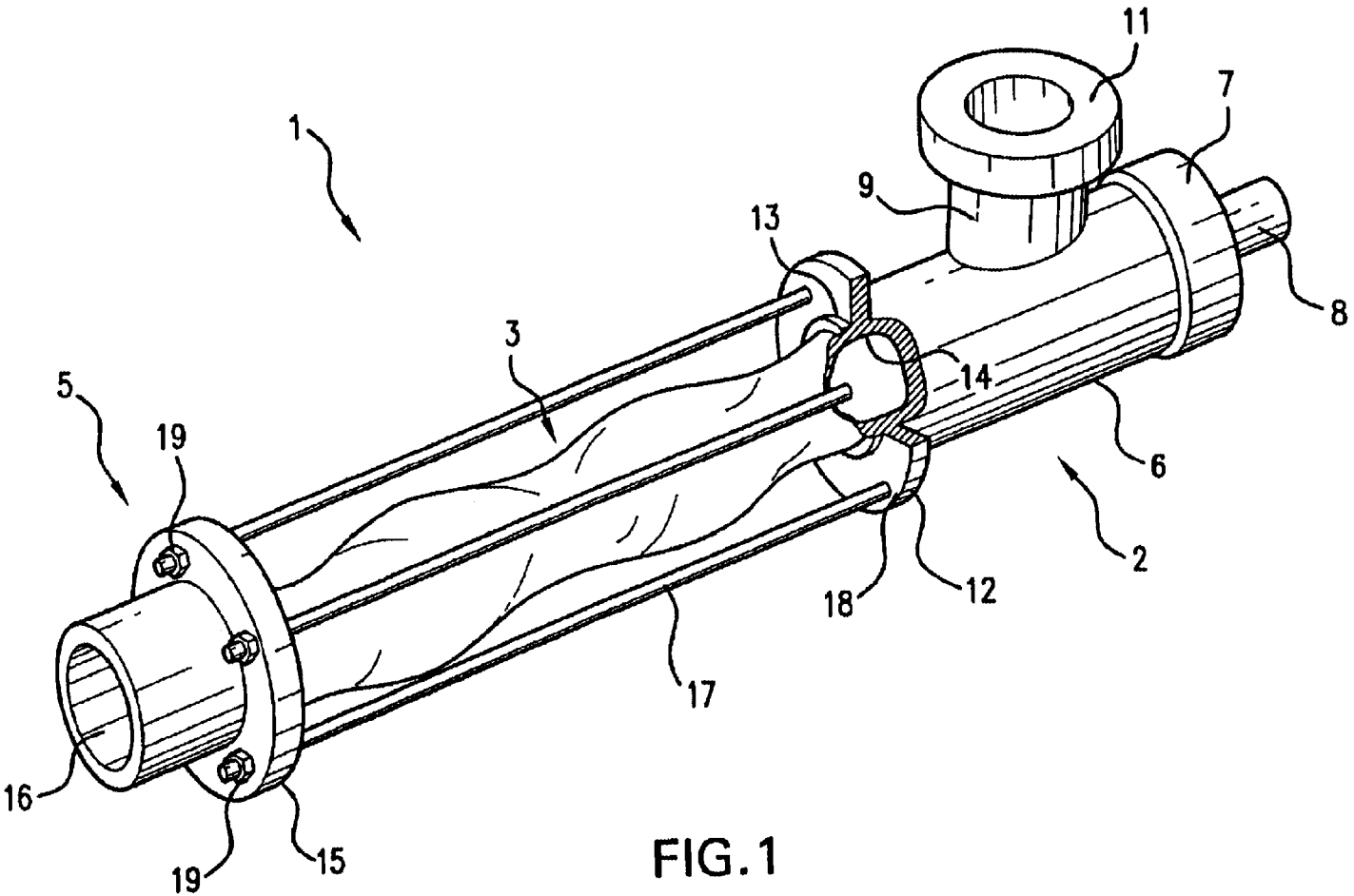
FIG. 1 shows a perspective illustration, partially cut away, of an eccentric screw pump.

FIG. 1 shows a schematic, perspective illustration of an eccentric screw pump 1 according to the invention. The eccentric screw pump 1 contains a pump head 2, a stator 3, in which a rotor 4, which is illustrated in broken-away form in FIG. 2, rotates, and a connection head 5.

The pump head 2 has an essentially cylindrical housing 6 which is provided, at one end, with a terminating cover 7, through which a drive shaft 8 is routed outwards in a sealed manner. Opening out radially into the housing 6 is a connection stub 9 which terminates at a fastening flange 11. A coupling element is located in the interior of the housing 6, as is as is [sic] customary in the case of eccentric screw pumps, in order for the drive shaft 8, which is connected to the drive motor (not illustrated), to be coupled in a rotationally fixed manner to the rotor 4.

That end of the housing 6 which is remote from the cover 7 is provided with a clamping flange 12, of which the diameter is greater than the diameter of the essentially cylindrical housing 6. The clamping flange 12 contains a stepped bore 13 which is aligned with the interior of the housing 6. Formed in the stepped bore is a planar abutment shoulder 14, against which the stator 3 is pressed by one end.

The connection head 5 has a clamping flange 15 which interacts with the clamping flange 12 and likewise contains a stepped bore, in which the other end of the stator 3 is inserted. An outgoing pipeline 16 is aligned with the stepped bore.

The stator 3 is clamped firmly in a sealed manner between the two clamping flanges 12 and 15 with the aid of a total of 4 tie rods 17. In order to accommodate the total of the 4 tie rods 17, the two clamping flanges 12 and 15 are each provided with four bores 18 which are aligned with one another and are located on a pitch circle which is greater than the external diameter of the housing 6 and of the tube 16. The tie rods 17 lead through these bores 18. On the side which is remote from the opposite clamping flange 12 or 15, nuts 19 are screwed onto the tie rods 17 and help to tighten the two clamping flanges 12 and 15 in the direction of one another.

Figure 2:
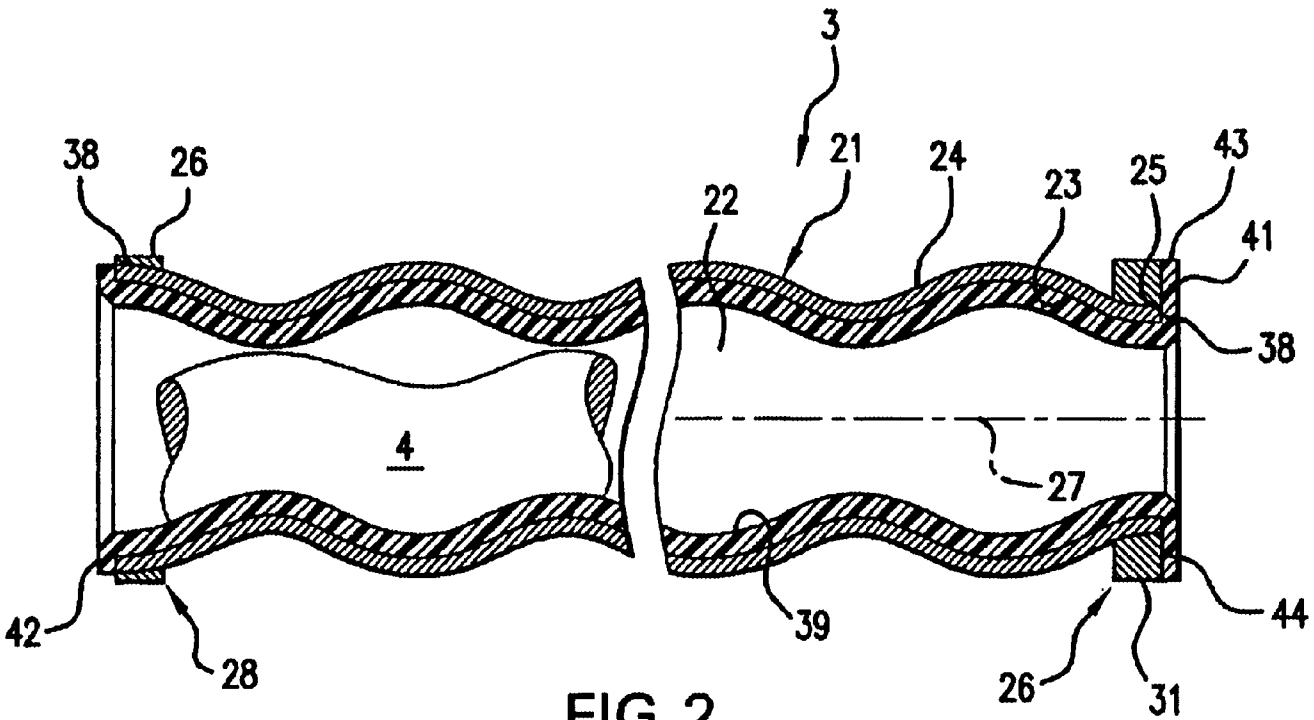
FIG. 2 shows a longitudinal section of the stator of the eccentric screw pump according to FIG. 1, FIG. 3 one end of the stator with the end ring placed in position and the casing illustrated in cut-away form.

As FIG. 2 shows, the stator 3 comprises a tubular casing 21, with a constant wall thickness, which encloses an interior 22. The casing 21 consists of steel, a steel alloy, light metal or a light-metal alloy. It is formed such that its inner wall 23 has the outer configuration of a multi-turn screw. Its outer side 24 has a correspondingly similar configuration and bounds a cross-sectional surface area which, corresponding to the wall thickness of the casing 21, is greater than the cross-sectional surface area which is bounded by the inner wall 23.

The casing 21 terminates at its ends with end surfaces 25 and 26, which run at right angles in relation to a longitudinal axis 27. The longitudinal axis 27 is also the axis of the casing 21 and of the interior 22.

In the simplest case of a two-turn screw, the cross section of the interior 22, and thus also the cross section which is enclosed by the outer surface 22, has the configuration of an oval similar to a racetrack, as seen at right angles to the longitudinal axis 27 in each case. In order to adapt this oval geometry to the stepped bore 13, a reducing or end ring 28 is seated on the casing 21 an [sic] each end. It consists of the same material as the casing 21.

The configuration of the end ring 28 and the precise outer geometry of the casing 21 in the region of the end ring 28 are explained in detail hereinbelow with reference to FIGS. 3 and 4.

The end ring 28 is bounded in the longitudinal direction by a planar end surface 29, which is adjoined by a cylindrical outer circumferential surface 31. A through-passage opening 32, which is enclosed by a wall 33, leads through the end ring 28. The through-passage opening 32 has a cross sectional surface area which coincides essentially with the cross-sectional surface area which bounds the outer wall 24 of the casing 21. The configurations do not coincide precisely. The difference results from the explanation [sic], which will be given below, of the stator geometry.

The through-passage opening 32 has a helical configuration, the number of turns and the lead coinciding with the number of turns and the lead of the helical configuration of the outer wall 24 of the casing 21.

Figure 4:
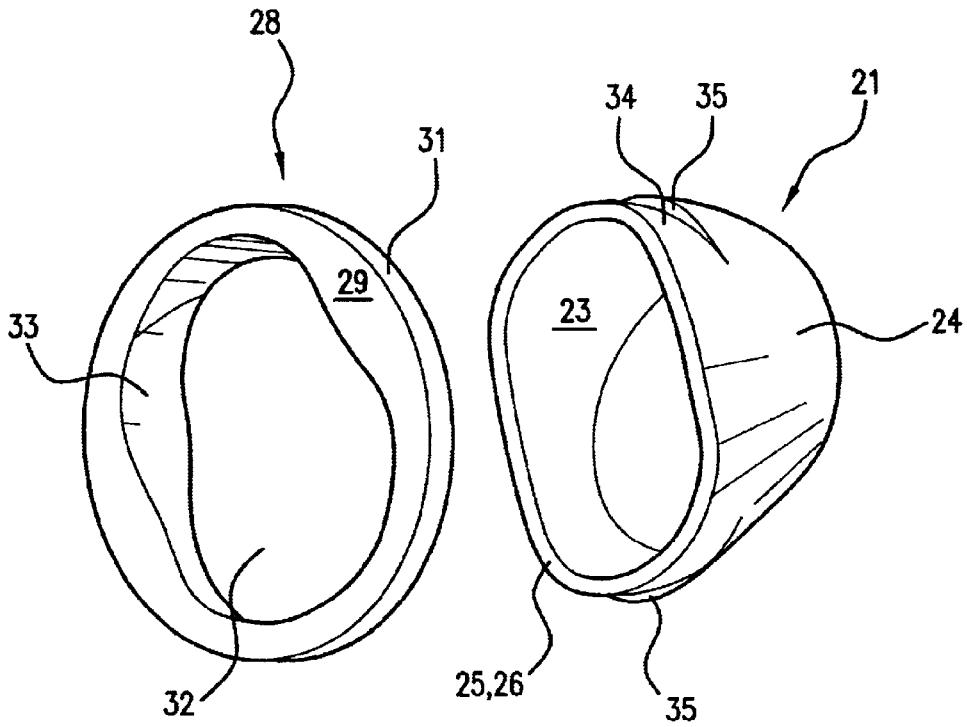
FIG. 4 shows a perspective exploded illustration of the end ring and a section of the casing.

As can be seen from FIG. 4, the casing 21 is stripped on its outer side. This produces, in those regions of the cross sectional surface area which is [sic] defined by the outer wall 24, a reduction in diameter, to be precise the outer wall 24 follows a cylindrical surface 34 in the stripping region.

In the case of a two-turn screw, the stripping produces a total of two sickle-shaped shoulders 35, which are spaced apart from the ends 24 [sic], 26 by a distance which corresponds to the stripping length, and which are both located in a common plane which is parallel to a plane which is defined by the end 25 or 26. The axial stripping depth i.e. the distance between the shoulders 35 and the respectively adjacent end 25 or 26, is somewhat smaller than the thickness of the end ring 28.

Despite the stripping of the outer circumferential surface, the outer wall 24 retains, even in the region between the end 25 or 26 and the adjacent shoulders 35, a helical configuration of which the lead coincides with the lead of the casing 21 on the other side of the shoulders 35.

As a result of the stripping, the wall thickness of the casing 21 on the thread crests between the shoulders 35 and the adjacent end 25 or 26 is somewhat smaller than in the rest of the regions. The reduction in wall thickness is restricted to the thread crests.

The cross-sectional surface area of the through-passage opening 32, as is bounded by the wall 33, corresponds to the cross-sectional surface area which bounds the outer wall 24 of the casing 21 in the region between the shoulder 35 and the nearest adjacent end 25 or 26.

As a result of this configuration of the end ring 28 it is possible for the latter, in a manner similar to a nut which is screwed onto a screw, to be screwed onto the outer side of the casing 21, until its end surface located opposite the end surface 29 butts against the shoulders 35.

Figure 3:
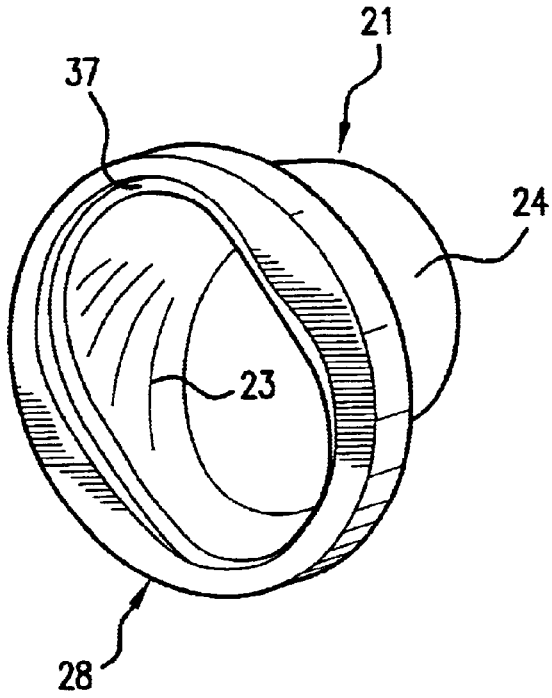

Placing the end ring 28 in position results in the configuration as is shown in FIG. 3. A continuous groove 37 is produced between the planar surface 29 and the adjacent end 25 or 26. In the region of the groove 37, once the end ring 28 has been placed in position, the end ring 28 is welded to the relevant end side 25 or 26. This results in the weld seams 38 which can be seen in FIG. 2.

The two end rings 28 are of identical configuration, although the wall thickness of the end ring 28 on the left-hand side of FIG. 2 is smaller, in the cross-sectional illustration, than the wall thickness of the end ring 28 on the right-hand side. This is because the cross-sectional profiles on the end surface 25 have been rotated through 90° in relation to the cross-sectional surface area on the end surface 26.

In its interior, the casing 21 is provided over its entire length with a continuous lining 39. The lining 39 consists of an elastomeric material, for example rubber, and has the same wall thickness at every point.

At the two ends of the stator 3, the lining 39 merges integrally into a seal 41 or 42 in each case. The seals 41, 42 have the configuration of a planar ring, of which the outer circumferential surface 43 is flush with the outer circumferential surface 31 of the respective end ring 28. One side of the seal 41, 42 is connected integrally to the planar surface 29 of the relevant end ring 28, while the planar surface 44 remote therefrom is oriented away from the stator 3 and constitutes the actual sealing surface.

The lining 39 is also retained integrally in the region of the weld seams 38.

If the stator 3 shown is plugged into the stepped bores 13 of the two clamping flanges 12 and 15, the relevant seals 41, 42 rest on the shoulder 14 in the respective stepped bore 13. By virtue of the tie rods being tightened, the clamping flanges 12 and 15 have their shoulders 14 pressed with sealing action against the seals 41 and 42.

The stator 3 described is produced as follows:

First of all, an originally cylindrical tube is cold-worked into the casing 21, which has the desired helical configuration. Then, starting from its two ends 25 and 26, the casing 21 is stripped to some extent on the outer side in order to produce the sickle-shaped shoulders 35. During stripping of the casing 21, the material is only removed in the region of the thread crests formed by the outer wall 24, albeit not to the extent where the wall material in the region of the thread crests disappears completely. In the case of a stator 3 with a maximum external diameter of 140 mm, for example, the shoulders have a radial depth of approximately 4 mm.

Thereafter, the end rings 28 are screwed onto each end of the casing 21 until they butt against the shoulders 35. The relevant end ring 28 is then welded to the end 25 or 26 along the groove 37. Further welding may take place on the outside.

The end rings 28 are subsequently connected both integrally and in a form-fitting manner to the casing 21. The planar surface 29 runs at right angles to the longitudinal axis 27.

As soon as the stator 3 has been prepared to this extent, the lining 39 is applied integrally in the casing 21 and on the planar surfaces 29. The stator 3 is thus complete and, as has been explained above, can be inserted into the eccentric screw pump 1.

As has already been described, the seals 41 and 42 merge integrally, without any separating surface, into the rest of the lining 39. This means that there is no gap at any point connecting the interior 22 within the lining 39 to the inner side 23 of the casing 21. In the case of the delivery of aggressive media which may corrode the casing 21, for example, there is no risk of the medium being able to advance through any separating gap between the lining 39 and the seals 41, 42 to the casing 21. The innerside 23 of the casing 21 is sealed in an effective manner. It is also the case that there is no risk of the medium delivered being able to damage the integral connection between the lining 39 and the inner side 23 of the casing 21 and penetrating into said separating surface.

In addition to the fact that the seals 41 and 42 hermetically seal the interior 22 within the lining 39 in relation to the casing 21, they also protect the separating surface between the lining 39 and the inner wall 23 of the casing 21 against the detachment or the penetration of delivered medium, for example, from the pressure side.

The rotor 4, which rotates in the lining 39, produces constant flexing and attempts to carry along the lining 39 in its direction of rotation. On account of the sealing abutment and of the prestressing by which the rotor 4 butts against the lining 39 and deforms the latter, the rotor 4 constantly pushes material of the lining 39 in front of it in a circumferential direction during its rotary movement. This results in the abovementioned flexing and in the carry-along action in the circumferential direction.

In a central region of the lining 39, each volume element of the flexing zone is secured in the axial and circumferential direction in each case by adjacent regions of the lining.

This condition applies in the case of the prior art, but not as far as the ends of the lining are concerned. A volume element located at the border has a free end edge at which the flexing forces are absorbed exclusively by the integral bonding of the volume element. There is no adjacent volume element here for absorbing the forces as well, for which reason there is increased risk, at the border, of the integral connection between the lining 39 and the casing 21 being separated by the flexing. As a result, the lining 39 would [lacuna] loose in this region, and the effect which originally occurred only at the end of the lining 39 displaces itself increasingly in the direction of the axial center, i.e. in the direction of the other end of the stator 3.

The integrally formed seals 41 and 42 prevent this effect. They ensure that, for a volume element of the lining 39, the fastening conditions prevailing at the ends are similar to those in a central region remote from the end. The flexing zone at the end is thus also fixed by the seal and is therefore connected to the casing 21 at the two axial ends. The integrally formed seal 41 and 42 mechanically protects the material-flow [sic] connection between the lining 39 and the casing 21 against release or tearing.

The configuration according to the invention of the stator 3 has been explained in detail above with reference to an eccentric screw pump as the application example. The person skilled in the art, however, knows that an eccentric screw pump may also be operated as a motor if a medium is pressed through the stator 3 at high pressure. This case is also subject to the same problems as have been explained above with reference to the eccentric screw pump.

As can be gathered from the above explanation, the two shoulders 35 serve essentially as an installation aid, in order to ensure that the end ring 28 is fixed on the casing 21 in the correct position prior to welding.

Instead of providing the shoulders on the casing 21, it is also conceivable for the through-passage opening 32 to be of stepped configuration, such that, in a region located in the direction of the thickness of the end ring 28, it has a cross-sectional surface area which corresponds to the cross-sectional surface area which is defined by the outer wall 24, while another, adjacent region has a smaller cross-sectional surface area, albeit of similar configuration. The shoulder is thus displaced into the end ring 28 which, following installation in the shoulder surface thus produced, butts against the end side 25 or 26.

As can be gathered from the illustration, the end ring 28 acts like a type of bandage, additionally fixing and stabilizing the configuration of the casing 21 in the region of its ends 25, 26.

In the case of an eccentric screw pump or an eccentric screw motor, the casing 21 has a helical configuration both on its outer wall and on its inner wall. In order to stabilize the cross-sectional profile of the casing 21 in the region of its ends, and to allow straightforward coupling to the other housing parts 5, 6, an end ring 28 is fitted at each end of the casing 21. The end ring 28 contains a through-passage opening 32, of which the cross-sectional surface area, as far as its configuration is concerned, coincides essentially with the cross-sectional surface area which is bounded by the inner wall 23 and/or the outer wall 24.

What is claimed is:

1. An eccentric screw pump or motor comprising:

a stator which has a tubular casing made of a solid material and comprising an inner side and an outer side, the casing comprising a constant wall thickness, and the interior of the casing having a helical configuration, and the contour of the outer side of the casing following the contour of the inner side of the casing, a lining which is located in the casing and has a constant thickness over a region of its length, and an end ring which is arranged at at least one end of the casing and contains a through-passage opening which has a configuration which substantially corresponds to the interior of the stator and, over the thickness of the end ring, runs helically with the same lead and number of turns as the interior of the stator.

2. The eccentric screw pump or motor as claimed in claim 1, wherein the end ring is configured such that, it can be screwed at least to some extent onto the casing.

3. The eccentric screw pump or motor as claimed in claim 1, wherein the cross-sectional surface area of the through-passage opening is not at any point smaller than the cross-sectional surface area of the interior of the casing.

4. The eccentric screw pump or motor as claimed in claim 1, wherein the through-passage opening constitutes essentially a continuation of the interior of the casing, optionally comprising a different inside width.

5. The eccentric screw pump or motor as claimed in claim 1, wherein the through-passage opening at least to some extent constitutes essentially a continuation of the screw which is defined by the outer wall of the casing.

6. The eccentric screw pump or motor as claimed in claim 1, wherein the cross-sectional surface area of the through-passage opening is smaller, over a section of the length thereof, than the cross-sectional surface area of the outer contour of the casing.

7. The eccentric screw pump or motor as claimed in claim 1, wherein the end ring contains a stepped opening which is subdivided in the longitudinal direction into two sections, of which the first is adapted to the outer configuration of the casing and the second constitutes essentially a continuation of the interior of the casing.

8. The eccentric screw pump or motor as claimed in claim 1, wherein, at that end at which the end ring is seated, the casing is provided with a shoulder.

9. The eccentric screw pump or motor as claimed in claim 8, wherein, at least at one of its ends, the casing is provided with a reduction in its outer dimensions extending at least over part of its outer circumference, and wherein the shoulder is formed by the reduction.

10. The eccentric screw pump or motor as claimed in claim 9, wherein, in the region of the reduction in diameter, the outer contour of the casing follows a cylinder surface.

11. The eccentric screw pump or motor as claimed in claim 1, wherein the end ring contains a through-passage opening which has the same cross-sectional surface area at all points.

12. The eccentric screw pump or motor as claimed in claim 1, wherein the end ring is connected integrally to the casing.

13. The eccentric screw pump or motor as claimed in claim 12, wherein the end ring is welded to the casing.

14. The eccentric screw pump or motor as claimed in claim 13, wherein a weld seam is located on the end side of the casing.

15. The eccentric screw pump or motor as claimed in claim 1, wherein the casing consists of steel, a steel alloy, light metal or a light-metal alloy.

16. The eccentric screw pump or motor as claimed in claim 1, wherein the end ring has a radially outwardly extending surface.

17. The eccentric screw pump or motor as claimed in claim 16, wherein the radially outwardly extending surface is a planar surface.

18. The eccentric screw pump or motor as claimed in claim 1, wherein the end ring is a casting.

19. The eccentric screw pump or motor as claimed in claim 1, wherein, on its outer side, the end ring is subjected to follow-up cutting over part of its length.

20. The eccentric screw pump or motor as claimed in claim 1, wherein the end ring has a circular outer contour.

21. The eccentric screw pump or motor as claimed in claim 1, wherein the lining is formed by an elastomer.

22. The eccentric screw pump or motor as claimed in claim 21, wherein the lining continues at least into the end ring.

23. An eccentric screw pump or motor comprising:

a stator which has a tubular casing made of a solid material and comprising an inner side and an outer side, the casing comprising a constant wall thickness, and the interior of the casing having a helical configuration, and the contour of the outer side of the casing following the contour of the inner side of the casing, a lining which is located in the casing and has a constant thickness over a region of its length, and an end ring which is arranged at at least one end of the casing and which comprises an opening, the contour of which follows the outer contour of the casing in a circumferential direction as well as an axial direction.

24. An eccentric screw pump or motor comprising:

a stator which has a tubular casing made of a solid material and comprising an inner side and an outer side, the casing comprising a constant wall thickness, and the interior of the casing having a helical configuration, and the contour of the outer side of the casing following the contour of the inner side of the casing, a lining which is located in the casing and has a constant thickness over a region of its length, and an end ring which is arranged at at least one end of the casing and which comprises an opening having a helical configuration which corresponds, in terms of the number of turns and the lead, to the number of turns and lead of the helical configuration of the outer side of the casing.

* * * * *